United States Patent [19]

Foshee

[11] Patent Number: 4,726,613

[45] Date of Patent: Feb. 23, 1988

[54] FIRE SAFETY DOOR LATCH

[75] Inventor: William R. Foshee, Indianapolis, Ind.

[73] Assignee: Best Lock Corporation, Indianapolis, Ind.

[21] Appl. No.: 835,511

[22] Filed: Mar. 3, 1986

[51] Int. Cl.[4] ..... E05C 1/16

[52] U.S. Cl. ..... 292/167; 292/DIG. 66; 292/150; 292/245

[58] Field of Search ..... 292/150, 167, 245, DIG. 66

[56] References Cited

U.S. PATENT DOCUMENTS

| | | | |
|---|---|---|---|
| 1,086,126 | 2/1914 | Berry . | |
| 2,253,547 | 8/1941 | Adams | 70/208 |
| 3,318,123 | 5/1967 | Piazza | 292/150 X |
| 3,705,739 | 12/1972 | Adler | 292/92 |
| 3,811,717 | 5/1974 | Floyd et al. | 292/92 |
| 4,183,565 | 1/1980 | Allemann | 292/150 X |
| 4,437,693 | 3/1984 | Godec | 292/150 X |
| 4,589,691 | 5/1986 | Foshee et al. | 292/150 X |

*Primary Examiner*—Richard E. Moore

*Attorney, Agent, or Firm*—Barnes & Thornburg

[57] ABSTRACT

A door latch bolt spring-biased to projected position and retracted by a lever or other unbalanced handle is provided with a blocker plate loosely mounted on the rear face of the bolt and held in nonblocking position by a fusible pin or other heat-sensitive element. In case of fire, when elevated temperature may weaken the biasing spring and allow the unbalanced handle to exert retracting force on the latch, the heat-sensitive element releases the blocker plate and allows it to drop to an operative position where it will move against a stop to block retraction of the bolt. The plate is movable in either direction on the bolt so as to be operative on either hand or door. The tailpiece of the latch bolt carries means for mounting a reaction plate for the biasing spring and the blocker plate is loosely received between such plate and the rear face of the latch bolt. The reaction plate can be omitted when the blocker is not used, but can be supplied at any stage of manufacture or in the field when desired.

21 Claims, 4 Drawing Figures

FIRE SAFETY DOOR LATCH

BACKGROUND AND SUMMARY OF THE INVENTION

This invention relates to door latching systems, and particularly to a door lock for use in a fire-rated door, the door lock having a latch blocker actuable by a fusible link to prevent inadvertent or accidental retraction of the latch bolt under fire conditions.

All too often doors are inadvertently or accidentally opened during a fire as a result of spring failure under heat or high velocity fire hose spray. To reduce the likelihood that the fire will spread or increase in intensity, it is necessary to ensure that a closed fire-rated door stay closed by retaining the latch bolt in its door latching position. In that manner, unwanted draft through the doorway closed by the fire-rated door is minimized.

It is well known that biasing springs used in door locks to bias a door latch toward its latching position lose temper when subjected to high spring-annealing temperatures during fire conditions. Loss of spring temper during a fire is particularly troublesome in the case where the door latch is operated by a lever or other unbalanced handle. The eccentric mass of such a lever is often sufficient to exert inadvertently or accidentally a retracting force on the latch bolt when the latch-biasing spring is weakened by exposure to high fire condition temperatures. In addition, levers can be actuated to withdraw the latch bolt inadvertently or accidentally if the lever is struck by a high velocity stream of water from a fire hose operated by fireman.

Temperature-activated latch bolt blocking systems are known, hereinafter referred to as "fusible systems." Operation of conventional fusible systems installed in mortise lock cases and the like have yielded less than satisfactory results for a number of reasons. An improved fire safety door lock of compact size and installable so as to be operative on either hand of door without the need for subsequent conversion or modification would avoid undesirable shortcomings of known fusible systems.

Conventional fusible systems are generally large, bulky apparatus and not easily for conveniently installed in a mortise lock case. Those skilled in the art will appreciate that interior space inside a mortise lock case is at a premium. In addition, conventional fusible systems are typically mounted directly to the case itself and thus not easily converted or otherwise adapted to block the latch bolt if the door providing a housing for the fusible system is itself converted from left-handed to right-handed operation, and vice versa. Such conversion is generally accomplished by removing, inverting, and reinstalling the latch bolt. In such a case, it is generally necessary either to: (1) replace a conventional fusible system for use in a door of one hand with another such system specifically designed for use with a door of the other hand, or (2) modify the latch bolt or other latching components to accommodate the fusible system.

According to the present invention, an improved door lock includes a case, a latch bolt guided within the case between latching and nonlatching positions and yieldably biased by spring means toward its latching position, a blocker member movable between an inoperative position and a blocking position, and fusible means for releasably coupling the blocker member to the latch bolt to hold the blocker member in its inoperative position. The blocker member and the latch bolt are decoupled following exposure of the fusible means to fire condition temperatures. The decoupled blocker member is then gravitationally urged to its blocking position so as to block substantial movement of the latch bolt toward a nonlatching position. Typically, such movement is induced by failure of the spring means during exposure to fire condition temperatures.

In preferred embodiments, the door lock further includes handle means for retracting the latch bolt against the spring means to a nonlatching position within the case. The handle means is a lever and can be expected to induce retraction of the latch bolt once the spring means is weakened by exposure to a spring-annealing temperature during fire conditions. Preferably, the fusible means is made of a material which melts at a temperature below the annealing temperature of the spring means.

The door lock further includes means for suspending the blocker member in its blocking position between the latch bolt and a stop member formed in the case to block movement of the latch bolt toward a nonlatching position. Preferably, the suspending means is defined by a tailpiece extending from a rear face of the latch bolt. In preferred embodiments, the blocker member is formed to include a tailpiece-receiving slot forming first and second interior walls spaced apart in mutually confronting relation thereby permitting one of the interior walls to suspend the blocker member in a blocker position when the door is adapted for left-handed operation, the other interior wall being positioned to suspend the blocker member in its blocking position when the door is adapted for right-handed operation.

One feature of the present invention is the provision of fusible means for releasably coupling a blocker member to the latch bolt itself to hold the blocker member in its inoperative position. In preferred embodiments, the blocker member can take the form of a single deadlocking plate that can fall to a blocking position when actuated during fire conditions. Advantageously, such a plate is compact in size and can be mounted easily in a variety of locations in the lock case.

One other advantage is that the blocker member of the present invention is always operative on either hand of the door without need for conversion or other modification since it is always fixed directly to the latch bolt itself. In the present invention, the latch bolt is the only component that must be reoriented to change a lock from right-handed to left-handed operation (or vice versa). Reorientation of the latch bolt to facilitate the opening of either a left-handed or a right-handed door automatically reorients the blocker member so as to permit the blocker member to fall under gravity to its blocking position without the need for substantial retrofit or service operations.

Another feature of the present invention is the provision of a stop member on the lock case for engaging the decoupled blocker member in its lowered blocking position to prevent inadvertent or accidental withdrawal of the latch bolt. The stop member is easily formed during a stamping operation and is operative whether the door is adapted for left-handed or right-handed operation. In addition, it is very economical to include the stop member as a permanent feature in all lock cases so that the only step necessary to add a temperature-activated latch-blocking system to the lock is to remove the latch bolt, mount the blocker member to the rear face thereof by means of a fusible pin or the like, and reinstall the modified latch bolt. It is unnecessary to modify the case in any way since the stop member is an unobtrusive permanent fixture thereon.

Additional features and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
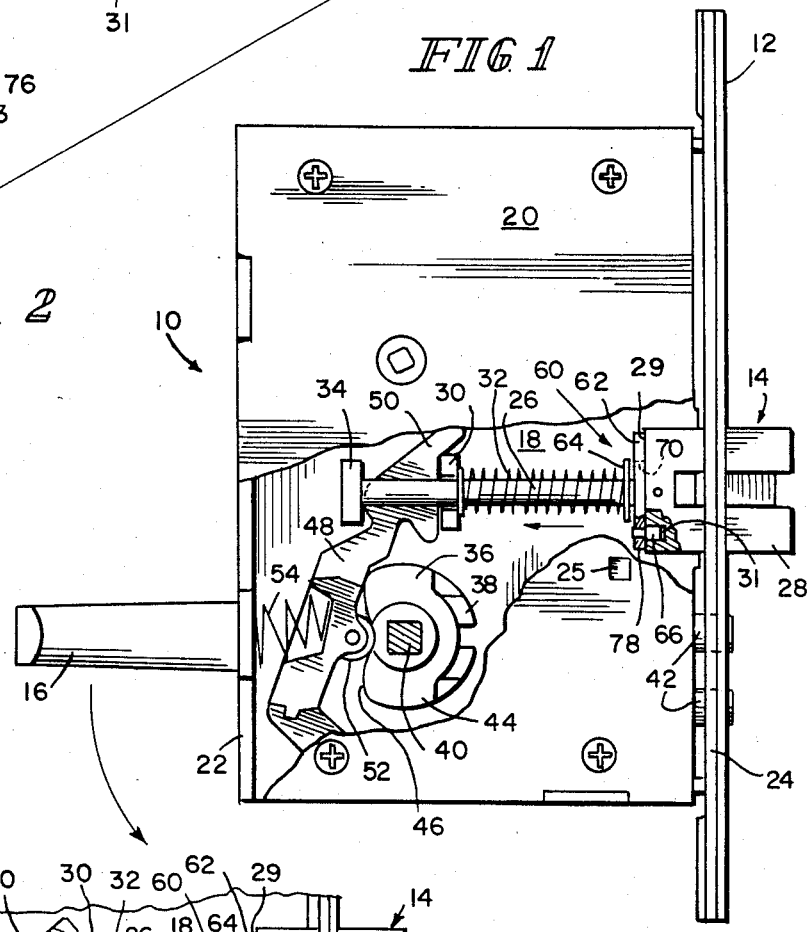
FIG. 1 is a side elevation view of a lever-handled mortise lock case incorporating a preferred embodiment of the present invention therein, with portions broken away to show a blocker member in its inoperative position.

A mortise lock 10 is illustrated in FIG. 1 and provides a suitable environment for the fire safety door lock of the present invention. The mortise lock 10 includes a generally rectangular case mountable in a cavity in the edge of a door (not shown) with its edge face 12 exposed at such edge. The lock 10 has a latch bolt 14 which is selectively operable by an outside lever hand 16. Reference is hereby made to U.S. Ser. No. 544,630 filed Oct. 24, 1983, which application describes the construction and operation of a mortise lock set suitable for use with a fire safety door lock of the present invention.

Figure 3:
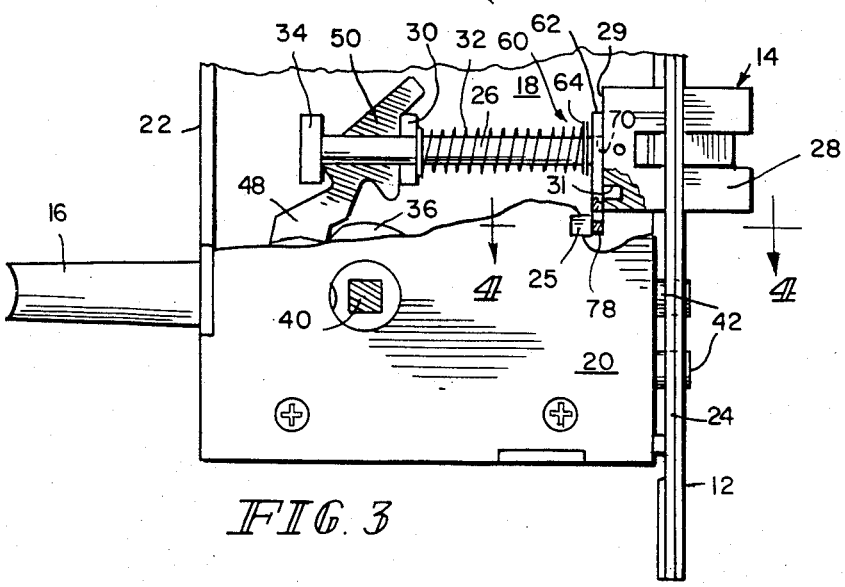
FIG. 3 is a view similar to the view in FIG. 1 showing the blocker member suspended in its blocking position.

The box-like mortise lock case comprises a bottom or back wall 18 and a cover or front wall 20 interconnected by a rear edge wall 22 and by a front edge face member 24 affixed by screws to the top and bottom edge walls of the rectangular case. An inwardly-extending stop member 25 is formed in front wall 20 of case 10 for use in blocking rearward movement of latch bolt 14 during a fire. The latch bolt 14 projects through the face member 24 and has a tailpiece 26 extending rearward from the head 28 of the bolt 14 through a reaction collar 30 fixed between the front and back walls 20, 18 of the case. The latch bolt head 28 includes an inner wall 29 formed to include a bore 31 as best shown in FIGS. 1 and 3. The bore 31 is sized to receive a fusible link of the type described below. The tailpiece 26 is surrounded by a biasing spring 32 which acts between the latch bolt head 28 and the reaction collar 30. The tailpiece 26 extends there beyond and carries a tail plate 34 at its rear end.

An inside lock-operating hub 36 and an outside lock-operating hub 38 are mounted coaxially in bearing holes in the front and back walls 20, 18 of the case 10. Each hub has an axial square hole (not shown) to receive the end of a lever handle spindle 40 for connecting its associated inside or outside lever handle to rotate the lock-operating hub 36 or 38.

The outside hub 38 carries a flange having a slot into which a stop plate (not shown) is projected when the upper of the two stopwork buttons 42 is depressed, so as to lock the outside lock-operating hub 38 against rotation. Depression of the lower button releases the outside hub 38 for rotation by its lever handle 16. The inside hub 36 is cut away in the vicinity of such stopwork plate so that it is freely rotatable under all conditions.

The inside and outside lock-operating hubs 36, 38 each include a cam flange 44 formed with a section of a heart-shaped cam surface 46. A retraction lever 48 is pivotally mounted on a pivot pin extending between the front and back walls 20, 18 of the case 10 and extends upward and forward past the hubs 36, 38. The retraction lever 48 includes a nose 50 which lies between the tailpiece 26 and back wall 18 of the case 10 and in engagement with the tail plate 34 of the latch bolt 14. The retraction lever 48 also includes a cam follower 52 adapted to seat on the heart-shaped cam surface 46. A spring 54 acts between rear edge wall 22 and the retraction lever 48 to bias the cam-follower 52 into camming engagement with the cam flange 44.

Figure 2:
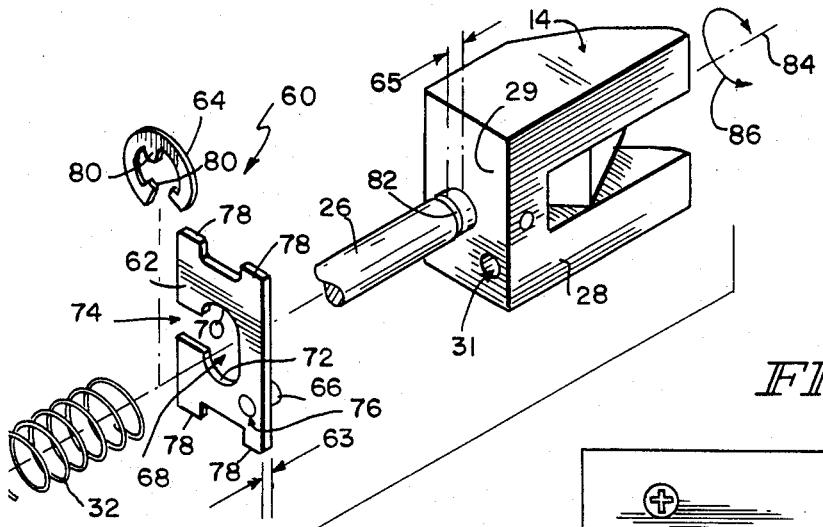
FIG. 2 is an exploded assembly view of the embodiment shown in FIG. 1.

A latch-blocking assembly 60 is illustrated in FIG. 2 and includes a deadlocking slide plate 62, a retainer 64, and a fusible link 66. The slide plate 62 is desirably made of sheet steel having a thickness 63 of about 0.060 inches (1.52 mm) and includes a tailpiece-receiving slot 68 having first and second interior walls 70, 72, an access opening 74, and a fusible link-receiving aperture 76. The slide plate 62 also includes an ear 78 extending outwardly from the main rectangular body of the slide plate 62 at each of its four corners. In use, one of those ears 78 will be positioned to intercept and engage stop member 25 thereby limiting retractive movement of the latch bolt 14 during a fire.

The retainer 64 is desirably a conventional external "E-shaped" retaining ring having three radially-inward tabs 80 for engaging an annular groove 82 formed in tailpiece 26 at distance 65 from inner wall 29 of latch bolt head 28 as shown in FIG. 2. Preferably, distance 65 is roughly equivalent to thickness 63 of slide plate 62. The fusible link 66 is desirably made of a 50/50 solid core solder formed in the shape of a cylinder having a diameter of about 0.125 inches (6.35 mm). It is necessary to provide only one fusible link 66, which link will melt to release the deadlocking slide plate 62 to its blocking position regardless of the orientation of latch bolt 14.

The embodiment of the fire safety lock shown in FIGS. 1–4 is desirably assembled as shown in FIG. 2. The deadlocking slide plate 62 is positioned relative to latch bolt 14 by inserting tailpiece 26 laterally through access opening 74 and fully into the tailpiece-receiving slot 68. Slide plate 62 is rigidly attached to the inner wall 29 of the latch bolt head 28 by means of a single fusible link 66 as shown in FIG. 1. Retainer 64 is installed on tailpiece 26 in engagement with annular groove 82 and between tailpiece biasing spring 32 and the slide plate 62 so that spring 32 acts to bias the latch bolt 14 toward its latching position shown in FIG. 1.

In operation, the deadlocking slide plate 62 is held in its inoperative position shown in FIG. 1 until the fusible link 66 is exposed to high temperature during a fire and melts, thereby decoupling the sliding plate 62 and the latch bolt head 28. The slide plate 62 is subsequently urged by gravity to its deadlocking position shown in FIGS. 3 and 4. Thus, slide plate 62 is lowered to its operative position to engage stop member 25 during rearward travel of latch bolt 14, which rearward travel is induced by the fire conditions, so as to block substantial movement of latch bolt 14 toward a retracted, nonlatching position (not shown). As explained previously, such rearward latch bolt travel can be induced inadvertently or accidentally in conventional locks by application of a retracting force to the tailpiece generated by either failure of tailpiece biasing spring 32 during exposure to fire condition temperatures or by an errant high velocity stream of water from a fire hose during firefighting activities.

The latch-blocking assembly 60 prevents spontaneous rearward travel of latch bolt 14 toward a nonlatching position since deadlocking slide plate 62 is released to fall under gravity to its deadlocking position before latch bolt-biasing spring 32 (or other biasing spring such as spring 54) is weakened by exposure to high temperature or otherwise fails. As shown best in FIG. 3, the arcuate first interior wall 70 of slide plate 62 intercepts the tailpiece 26 to suspend slide plate 62 in its deadlocking position when the latch bolt 14 is set up for "right-handed" operation. The fusible link 66 is formed out of a material which melts at a predetermined temperature below the annealing or weaking temperature of the springs used to bias the latch bolt 14 to its latching position. Thus, the latch-blocking assembly 60 is actuated prior to temperature-related spring failure so that the deadlocking slide panel 62 is positioned to resist tailpiece retraction forces generated by either of the above-noted phenomena.

Figure 4:
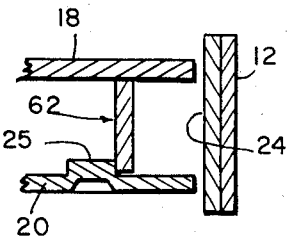
FIG. 4 is a cross-sectional view taken along lines 4—4 of FIG. 3 showing the blocker member in engagement with the stop member.

Those skilled in the art will appreciate that it is necessary only to rotate the latch bolt 14 by 180° about its longitudinal axis 84 in one of the two directions indicated by arrow 86 in FIG. 2 to change the lock from right-handed to left-handed operation or vice versa. Upon rotation of latch bolt 14, the deadlocking slide plate 62 is automatically reoriented to permit the slide plate 62 to fall under gravity to its deadlocking position without the need for substantial retrofit or service operations. The slide plate arrangement illustrated in the drawings is extremely versatile. When set up for right-handed operation as shown in FIGS. 1, 3, and 4, the arcuate first interior wall 70 is situated above tailpiece 26 to suspend the slide plate 62 in its deadlocking position; however, when set up for left-handed operation (not shown), the arcuate second interior wall 72 is expected to be situated above 26 to suspend the now-inverted slide plate 62 in its deadlocking position.

Although the invention has been described in detail with reference to a preferred embodiment, variations and modifications exist within the scope and spirit of the invention as described and defined in the following claims.

What is claimed is:

1. A door lock comprising a case including a stop member, a latch bolt, guide means within the case for guiding the latch bolt between latching and non-latching positions, spring means for yieldably biasing the latch bolt toward its latching position, a blocker member movable between an inoperative position and a blocking position, handle means for selectively retracting the latch bolt against the spring means, the handle means including tailpiece means rigidly connected to the latch bolt for suspending the blocker member in its blocking position between the latch bolt and the stop member, and fusible means for releasably coupling the blocker member to the latch bolt to hold the blocker member in its inoperative position, the blocker member and the latch bolt being decoupled in response to exposure of the fusible means to fire temperatures, the decoupled blocker member being gravitationally urged to its blocking position and being retained in such blocking position by the tailpiece means so as to block substantial movement of the latch bolt toward its non-latching position.

2. The door lock of claim 1, wherein the handle means is configured to retract the latch bolt and the blocker member against the spring means to a non-latching position within the case, the spring means is configured to exert a predetermined biasing force on the blocker member, thereby pressing the blocker member against the latch bolt until the spring means is weakened by exposure to an annealing temperature during fire conditions, and the fusible means melts at a temperature below the annealing temperature of the spring means.

3. The door lock of claim 1, wherein the latch bolt includes a rear face and the tailpiece means extends from the rear face of the latch bolt.

4. The door lock of claim 3, wherein the blocker member is formed to include a tailpiece-receiving slot forming a first interior wall normally positioned in spaced-apart confronting relation to the tailpiece means extending through the slot, the first interior wall being situated to intercept the tailpiece means during movement of the blocker member toward its blocking position, thereby to suspend the blocker member in its blocking position during fire conditions.

5. The door lock of claim 4, wherein the orientation of the latch bolt is variable to facilitate the opening of either a left- or right-handed companion door, the latch bolt is mountable in the case in a first orientation to latch a door of one of the left and right hands and a second orientation to latch a door of the other of the left and right hands, the tailpiece-receiving slot also forms a second interior wall in mutually confronting spaced-apart relation to the first interior wall, the first interior wall suspends the blocker member only in said first orientation of the latch bolt, and the second interior wall intercepts the tailpiece only in said second orientation of the latch bolt during movement of the blocker member toward its blocking position thereby to suspend the blocker member in its blocking position during fire conditions.

6. A door lock comprising a case including a stop member, a latch bolt having an exterior surface, support means within the case for guiding the latch bolt between latching and non-latching positions, spring means for yieldably biasing the latch bolt toward its latching position, a blocker member for selectively engaging the stop member, guiding means for guiding the blocker member between inoperative and blocking positions, fusible means for coupling the blocker member to the exterior surface of the latch bolt normally to hold the blocker member in its inoperative position, the blocker member being gravitationally urged to its blocking position upon melting of the fusible means during fire conditions so as to permit engagement of the stop member and the blocker member, thereby blocking movement of the latch bolt toward a non-latching position.

7. The door of claim 6, wherein the fusible means melts at a temperature below the annealing temperature of the spring means.

8. The door lock of claim 6, further comprising handle means for retracting the latch bolt and the blocker member against the spring means to a non-latching position within the case, the spring means being configured to exert a predetermined biasing force on the blocker member, thereby pressing the blocker member against the latch bolt until the spring means is weaked by exposure to an annealing temperature during fire conditions, the fusible means melting at a temperature below the annealing temperature of the spring means.

9. A door lock comprising a case including a stop, a latch bolt spring-biased to a projected position and coupled to a mechanism which subjects the bolt to retraction force likely to retract the bolt if the spring is weakened by heat, the latch bolt being selectively mountable in a first orientation to latch a door of one of the left and right hands and a second orientation to latch a door of the other of the left and right hands, a blocker member loosely carried on an exterior surface of the latch bolt, the blocker member being formed to include bi-directional means for selectively engaging the stop, the bi-directional means including first limit means for engaging the stop only in the first orientation of the latch bolt and separate second limit means for engaging the stop only in the second orientation of the latch bolt, and heat-sensitive means coupled to the exterior surface of the latch bolt for releasing the blocker member in the event the lock is subjected to high heat, the blocker member being normally held in non-blocking position by the heat-sensitive means and when so released being movable by gravity to a blocking position, the stop being fixed in an interior region of the case against which the blocker member will move when in a blocking position so as to block retraction movement of the latch bolt.

10. The door lock of claim 9, wherein the blocker member is mounted for movement in opposite directions.

11. A door lock comprising a case including a face plate formed to include an opening, a reaction collar, and a stop member, a bolt assembly including a latch bolt having a rear face and a tailpiece extending from the rear face of the latch bolt through the reaction collar, a biasing spring acting between the reaction collar and the latch bolt so that the latch bolt is normally biased to a latching position projecting through the face plate opening during exposure to a temperature that is lower than the annealing temperature of the spring, handle means for retracting the latch bolt against the biasing spring to a non-latching position within the case, the handle means being configured to induce retraction of the latch bolt in the event the spring is weakened by exposure to annealing temperature during fire conditions, a blocker member situated intermediate the biasing spring and the latch bolt, and fusible means for coupling the blocker member to the rear face of the latch bolt normally to hold the blocker member in an inoperative position on an exterior surface of the latch bolt in spaced-apart relation to the stop member, the blocker member being movable along the rear face of the latch bolt by gravity from its inoperative position to a lower blocking position upon melting of the fusible means during fire conditions so as to intercept the stop member in response to retracting movement of the latch bolt induced by the handle means after weakening of the biasing spring.

12. The door lock of claim 11, wherein the handle means includes a lever handle retractor assembly and spring means for yieldable biasing the latch bolt retractor assembly toward an inoperative position so that the mass of moment of inertia of the lever handle retractor assembly does not normally exert an opposing force sufficient to overcome the force exerted by the spring means to induce spontaneously movement of the latch bolt toward a nonlatching position, and the fusible means melts at a temperature below the annealing temperature of the spring means so as to block retraction movement of the latch bolt resulting from weakening of the spring means during fire conditions.

13. The door lock of claim 11, further comprising a tailpiece coupled to the latch bolt, and wherein the blocker member is formed to include a tailpiece-receiving slot forming a first interior wall normally positioned in spaced-apart relation to the tailpiece extending through the slot, and the first interior wall is situated to intercept the tailpiece during movement of the blocker member toward its blocking position thereby to suspend the blocker member in its blocking position during fire conditions.

14. The door lock of claim 13, wherein the orientation of the latch bolt is variable to facilitate the opening of either a left- or right-handed companion door, the latch bolt is mountable in the face plate opening in a first orientation to latch a door of one of the left and right hands and a second orientation to latch a door of the other of the left and right hands, the tailpiece-receiving slot also forms a second interior wall in mutually confronting spaced-apart relation to the first interior wall, the first interior wall suspends the blocker member only in said first orientation of the latch bolt, and the second interior wall intercepts the tailpiece only in said second orientation of the latch bolt during movement of the blocker member toward its blocking position thereby to suspend the blocker member in its blocking position during fire conditions.

15. The door lock of claim 14, wherein the fusible means melts at a temperature below the temperature at which the biasing spring loses its temper.

16. The door lock of claim 11, further comprising means for suspending the blocker member in its lower blocking position between the latch bolt and the stop member to block movement of the latch bolt toward a nonlatching position.

17. A door lock comprising a case including a stop member, a latch bolt including a rear face, guide means within the case for guiding the latch bolt between latching and non-latching positions, spring means for yieldably biasing the latch bolt toward its latching position, a blocker member movable between an inoperative position and a blocking position, suspending means for suspending the blocker member in its blocking position between the latch bolt and the stop member to block movement of the latch bolt toward a non-latching position, the suspending means including a tailpiece extending from the rear face of the latch bolt, and fusible means for releasably supporting the blocker member in a predetermined position in spaced relation to the tailpiece to hold the blocker member in its inoperative position, the blocker member being released in response to exposure of the fusible means to fire temperatures, the released blocker member being gravitationally urged to its blocking position and being retained in such blocking position by the tailpiece so as to block substantial movement of the latch bolt toward a non-latching position.

18. The door lock of claim 17, wherein the blocker member is formed to include a tailpiece-receiving slot forming a first interior wall normally positioned in spaced-apart relation to the tailpiece means extending through the slot, the first interior wall being situated to intercept the tailpiece means during movement of the blocker member toward its blocking position, thereby to suspend the blocker member in its blocking position during fire conditions.

19. The door lock of claim 18, wherein the orientation of the latch bolt is variable to facilitate the opening of either a left- or right-handed companion door, the latch bolt is mountable in the case in a first orientation to latch a door of one of the left and right hands and a second orientation to latch a door of the other of the left and right hands, the tailpiece-receiving slot also forms a second interior wall in mutually confronting spaced-apart relation to the first interior wall, the first interior wall suspends the blocker member only in said first orientation of the latch bolt, and the second interior wall intercepts the tailpiece means only in said second orientation of the latch bolt during movement of the blocker member toward its blocking position, thereby to suspend the blocker member in its blocking position during fire conditions.

20. A door lock comprising a case including a stop member, a latch bolt including a rear face, guide means within the case for guiding the latch bolt between latching and non-latching positions, spring means for yieldably biasing the latch bolt toward its latching position, a blocker member movable between an inoperative position and a blocking position, suspending means for suspending the blocker member in its blocking position between the latch bolt and the stop member to block movement of the latch bolt toward a non-latching position, the suspending means including a tailpiece extending from the rear face of the latch bolt, and fusible means for releasably coupling the blocker member to the latch bolt to hold the blocker member in its inoperative position, the blocker member and the latch bolt being decoupled in response to exposure of the fusible means to fire temperatures, the decoupled blocker member being gravitationally urged to its blocking position and being retained thereat by the suspending means so as to block substantial movement of the latch bolt toward a non-latching position, the blocker member being formed to include a tailpiece-receiving slot forming a first interior wall normally positioned in spaced-apart relation to the tailpiece extending through the slot, the first interior wall being situated to intercept the tailpiece during movement of the blocker member toward its blocking position, thereby to suspend the blocker member on the suspending means in its blocking position during fire conditions.

21. The door lock of claim 20, wherein the orientation of the latch bolt is variable to facilitate the opening of either a left- or right-handed companion door, the latch bolt is mountable in the case in a first orientation to latch a door of one of the left and right hands and a second orientation to latch a door of the other of the left and right hands, the tailpiece-receiving slot also forms a second interior wall in mutually confronting spaced-apart relation to the first interior wall, the first interior wall suspends the blocker member only in said first orientation of the latch bolt, and the second interior wall intercepts the tailpiece only in said second orientation of the latch bolt during movement of the blocker member toward its blocking position, thereby to suspend the blocker member in its blocking position during fire conditions.

* * * * *